US006309472B1

(12) United States Patent
Schönenberg et al.

(10) Patent No.: US 6,309,472 B1
(45) Date of Patent: Oct. 30, 2001

(54) METHOD OF AND APPARATUS FOR CLEANING STRIP LINE ROLLS

(75) Inventors: Rudolf Schönenberg, Hemer; Peter Biele, Witten; Wolfgang Nentwich, Duisburg; Rolf Noé, Mülheim a.d.Ruhr; Andreas Noé, Kerken, all of (DE)

(73) Assignee: BWG Bergwerk-und Walzwerk-Maschinenbau GmbH, Dusseldorf (DE)

( * ) Notice: Subject to any disclaimer, the term of this patent is extended or adjusted under 35 U.S.C. 154(b) by 0 days.

(21) Appl. No.: 09/413,360

(22) Filed: Oct. 6, 1999

(30) Foreign Application Priority Data

Oct. 20, 1998 (DE) ..... 198 48 174

(51) Int. Cl.[7] ..... B08B 1/02; B08B 3/02

(52) U.S. Cl. ..... 134/33; 134/18; 134/32; 134/144; 134/122 R; 134/15

(58) Field of Search ..... 134/18, 15, 33, 134/32, 144, 122 R

(56) References Cited

U.S. PATENT DOCUMENTS 4,178,652 * 12/1979 Adams et al. ..... 15/302
4,893,642 * 1/1990 Parslow, Jr. et al. ..... 134/66
5,636,681 * 6/1997 Sulzer et al. ..... 164/472

* cited by examiner

*Primary Examiner*—Zeinab El-Arini
(74) *Attorney, Agent, or Firm*—Herbert Dubno

(57) ABSTRACT

Rolls of a strip line are cleaned by directing jets of a cleaning liquid thereagainst from nozzles which are mounted so that their distances from the roll to be cleaned can be set or controlled.

18 Claims, 3 Drawing Sheets

METHOD OF AND APPARATUS FOR CLEANING STRIP LINE ROLLS

FIELD OF THE INVENTION

Our present invention relates to a method of and to an apparatus for the cleaning of rolls used in strip casting, rolling mills and/or other strip processing lines and especially the rolls used for dressing mill stands, sizing mill stands and finishing mill rolls, including mill rolls for the after-rolling of strip following the usual rolling process.

More particularly, the invention relates to a method of cleaning the rolls or rollers of a strip line of a type described which is used in the production and the processing of metal strip in all stages, including initial production, sizing, finishing and surface formation. The invention especially relates to a system in which the roll is cleaned by a jet from at least one nozzle of a cleaning liquid and in which the nozzle is moved back and forth along the roll. The metal strip to which the invention is applicable includes steel strip.

BACKGROUND OF THE INVENTION

It is known, especially in conjunction with zinc coating lines or galvanizing lines, to integrate dressing roll stands in the strip processing line to thereby emboss or otherwise impart certain surface properties to the strip and to alter in a targeted way the properties of the strip being processed. In such cases there is the danger that zinc particles, for example, which are only partly adherent to the strip can be transferred to the working and back-up rolls of a stand in the strip line. The zinc particles which remain adherent to the surface of the roll tend to be pressed into the surface with time and to imprint on subsequently rolled products, thereby introducing defects which may make a portion of the product unusable, which can require cutting out and scrapling of a portion of the product, and which can decrease productivity.

In order to reduce the risk of adhesion of particles on the rolls of a strip line and especially the rolls of a dressing mill or stand, it is known to operate the dressing stand in a wet condition. The result is a wet rolling of the strip under conditions in which particles tend to remain in the liquid and not to adhere to the dressing rolls.

Cleaning devices for such rolls in the form of brushes, fleece rollers and fleece cushions are known, these units being either as wide as the widest metal strip to be processed or being mounted to traverse along the effective length of the roll. The cleaning effect of brushes, fleece rollers and fleece cushions is, however, limited, and in many cases is unsatisfactory.

A high pressure liquid cleaning of the rolls has been proposed in which a wide mouth nozzle for each roll provides a water spray to clean the surface of the roll. With this system, the position of the cleaning nozzle cannot be varied. A nozzle system which is capable of moving along the roll is also known but this earlier system is satisfactory only for rolls of constant diameter with constant strip speeds. The wide mouth nozzle is not versatile in that especially dressing roller stands must have rolls of different roll diameter from time to time for processing different steel alloys and for different products made by the system. For example, a working roll may have a diameter of 450 mm when new and 400 mm when ground down for use with hard materials but 650 mm when new and 600 mm when ground down for softer materials. The backing rolls in this case may have diameters of 900 mm when new and 820 mm when ground down. The cleaning unit in the case of a broad slit nozzle is only properly positioned for one roll diameter and, for example if the roll is ground down, the cleaning effect is largely lost.

Similar problems arise with the rolls and roll stands used in extrusion casting and strip casting apparatus and in strip mills using continuous casting, as well as with the rolls used in rolling mill and strip processing lines.

In addition, in for example an aluminum process line problems arise with aluminum oxide which is more or less adherent to the strip surface and which can adhere to the rolls for the respective line, especially the stretching rolls of a processing line and can lead to growth of the deposit on the roll and the generation of surface defects.

OBJECTS OF THE INVENTION

It is, therefore, the principal object of the present invention to provide a method of cleaning rolls for strip casting lines, strip rolling lines and/or strip processing lines and especially dressing stand rolls or sizing rolls or post rolling treatment rolls, particularly dressing rolls, whereby an especially efficient cleaning is maintained for rolls of different diameters, for the processing of different strip materials and in the case of different strip speeds.

Another object of the invention is to provide a method of operating a strip line which involves the cleaning thereof whereby drawbacks of earlier systems are eliminated.

It is also an object of the invention to provide an apparatus which has been found to be especially suitable for carrying out the cleaning process and which can operate in a simple and reliable manner.

SUMMARY OF THE INVENTION

These objects and others which will become apparent hereinafter are attained, in accordance with the invention by adjusting and controlling the distance between the cleaning nozzle and the roll surface. The adjustment and control of the spacing allows a highly accurate establishment and maintenance of a given spacing so that the effect of changes in the distance upon changing roll diameter can be eliminated. The invention therefore operates with a cleaning nozzle of variable spacing with which it is relatively simple to match the cleaning nozzle spacing to various roll diameters. The consequence is an optimal cleaning effectiveness. This is the case when, according to another feature of the invention, the traversing speed for the back and forth movement of the cleaning nozzle is set in dependence upon the strip speed and/or the strip material and/or the strip surface. An especially efficient cleaning effect is obtained in this matter.

According to another feature of this invention, the spacing between the roll and the nozzle is maintained constant during the back and forth movements and hence from one repetition to the next and in spite of variations in the roll diameter. The distance or spacing should be smaller than 100 mm for greatest high pressure clean efficiency.

According to a feature of the invention the metal strip before contacting the roll can be subjected on its upper side and/or on its lower side to a hydromechanical cleaning with a cleaning liquid discharged from one or more jets. The cleaning of the roll can thus be greatly simplified and in many cases made superfluous.

According to another feature of the invention the jet is trained against the strip as it overshoots a roll. This has been found to improve the cleaning efficiency. The liquid jets used for cleaning the roll and/or the strip should be supplied with the cleaning liquid at at least 100 bar.

The cleaning liquid is preferably desalinated or salt free water and corrosion limiting additives can be added to the cleaning liquid.

The method of operating a strip line with a roll to be cleaned can comprise:

(a) training a jet of a cleaning liquid from at least one nozzle against a surface of the roll to be cleaned;

(b) displacing the nozzle back and forth along the roll while rotating the roll and the jet impacts the surface; and (c) controlling a spacing between the nozzle and the surface and regulating the spacing during the back and forth displacement of the nozzle to maintain a predetermined value of the spacing.

The apparatus, in turn, can comprise:

at least one nozzle training a jet of a cleaning liquid against a surface of the roll to be cleaned;

means for displacing the nozzle back and forth along the roll while rotating the roll and while the jet impacts the surface; and means for controlling a spacing between the nozzle and the surface and regulating the spacing during the back and forth displacement of the nozzle to maintain a predetermined value of the spacing.

With the apparatus, the roll or roller of a strip line for metal strip is cleaned by a cleaning nozzle which is traversed along the roll.

The key to the apparatus is that the cleaning nozzle is mounted on a piston and cylinder arrangement which is controllable and which varies the spacing of the nozzle from the roll. The nozzle can be mounted on either the piston or the cylinder of the arrangement, whichever is movable while the other is secured to the carriage which can be displaced on rails parallel to the roll.

The piston-and-cylinder arrangement can have a pneumatic or hydraulic cylinder and either one provides a simple system for adjusting the space between the nozzle and the surface of the roll to be cleaned.

The cleaning nozzle is preferably formed as a rotation nozzle which has been found to provide an especially effective cleaning.

The spray angle between the roll and the cleaning nozzle can be adjustable, for example between 60° and 120° and the inclination of the piston-and-cylinder arrangement can also be adjustable with respect to the roll. These adjustments can be controlled by a feedback system if desired.

Of course a plurality of cleaning nozzles can be spaced along the length of the body of the roll and can be traversed together parallel to the axis of the roll. When strip cleaning is to accompany the roll cleaning, one or more cleaning nozzles can be provided above or below the strip and can be directed with adjustable spray angles against the metal strip.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
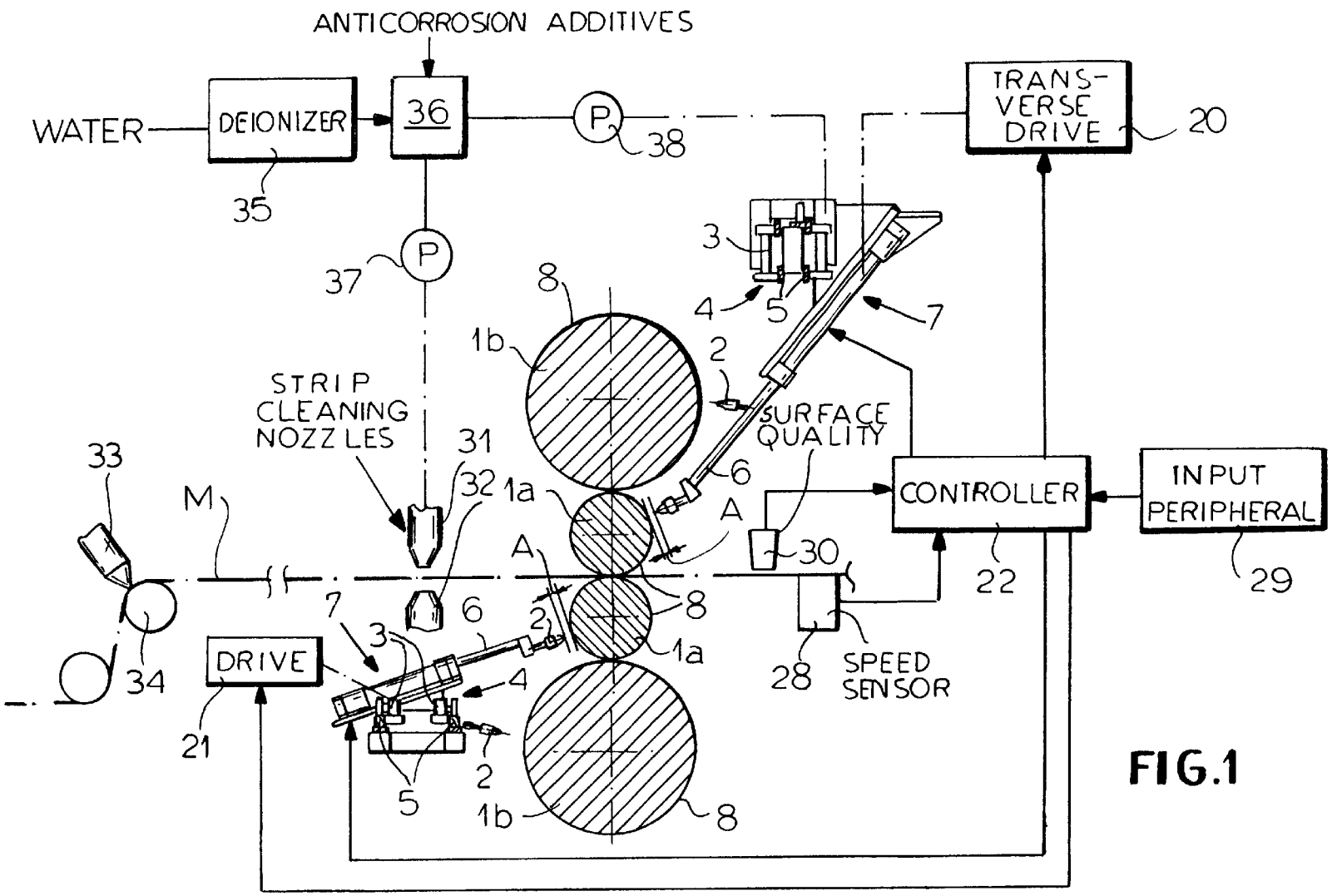
FIG. 1 is a vertical section through a portion of a strip line and specifically the dressing mill stand showing the principles of the invention.
Figure 2:
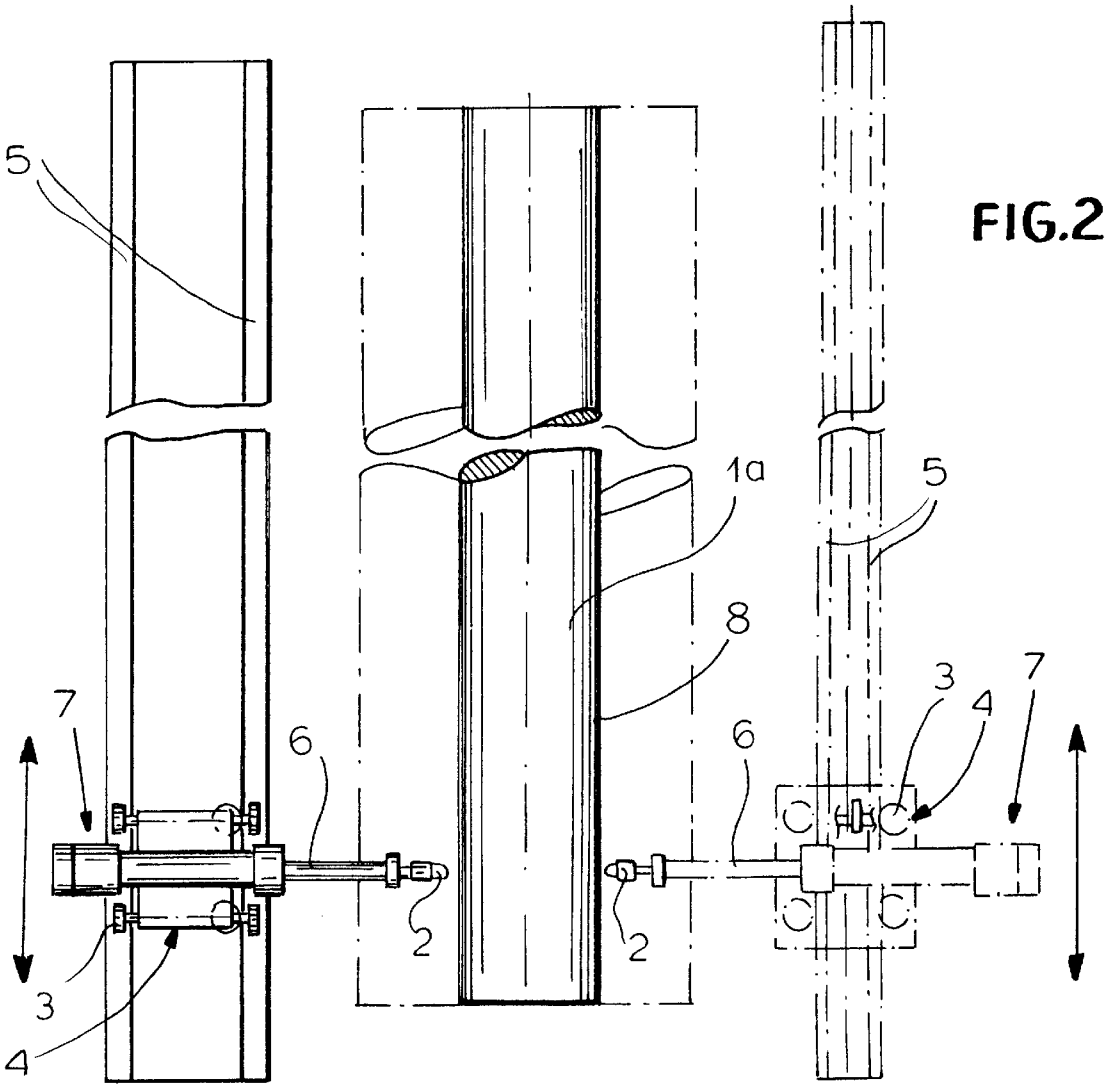
FIG. 2 is a plan view of the system of FIG. 1 but without the backup rolls.

In the drawing we have shown a system for cleaning the rolls 1*a* of a dressing stand, the rolls 1*a* having backup rolls 1*b* bracing them against the metal strip M. The rolls 1*a* and 1*b* are cleaned by jets of a cleaning liquid discharged from the nozzles 2 trained on the surfaces of the rolls. The cleaning nozzles 2 are displaceable back and forth along the rolls 1*a*, 1*b*, perpendicular to the plane of the paper in FIG. 1 and parallel to the plane of the paper in FIG. 2. For this purpose, the slides or carriages 4 are provided on guide rails 5 and have bogies or trucks 3 which cause the carriage 4 to travel back and forth on these rails at a speed which is determined by the respective drives 20 and 21. A controller 22 can provide signals for the drives 20 and 21 controlling the speeds thereof. In the illustrated embodiment, the cleaning nozzles 2 are carried.

Figure 3:
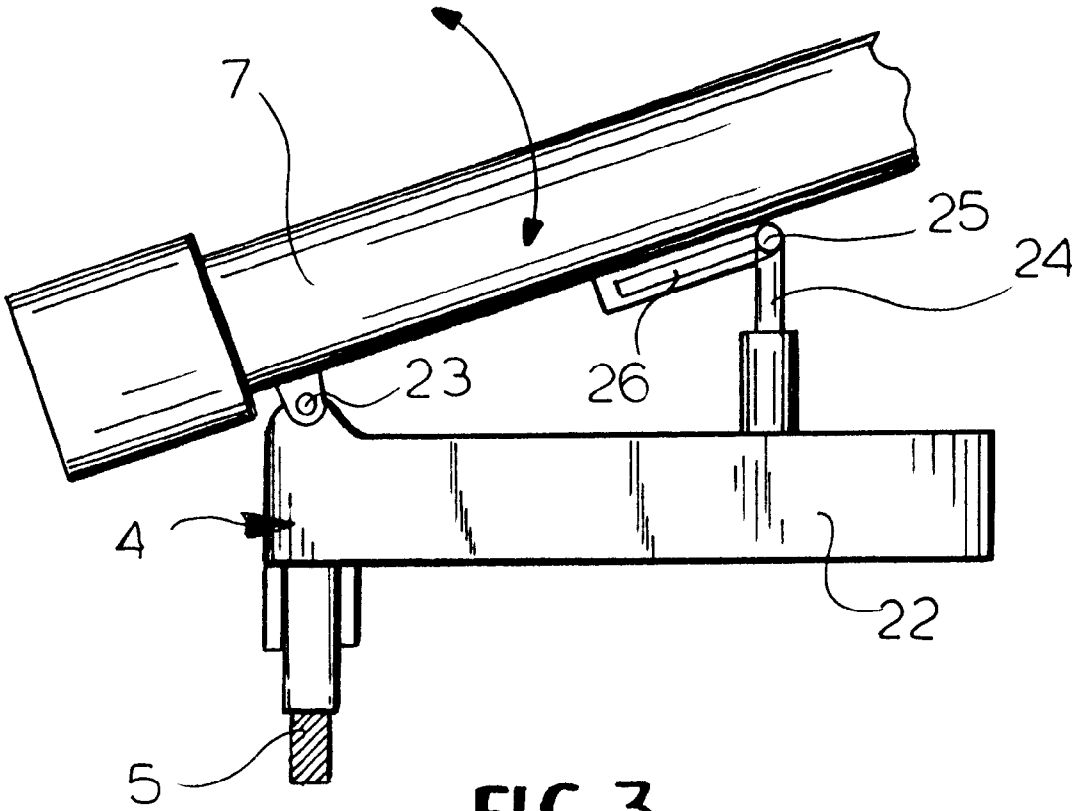
FIG. 3 is a detail showing the adjustment of the angular positions of the piston and cylinder arrangement.

The piston-and-cylinder arrangements 6, 7, are mounted on the carriages 4. As shown in FIG. 3, for example, the angular orientation of a cylinder 7 may be adjusted by providing each cylinder 7 with a pivot 23 on the carriage 4 and displacing that cylinder by a positioning piston 24 of a servocylinder whose end 25 is guided in a slot 26 along the cylinder 7. In the embodiment illustrated the cylinders are all pneumatic cylinders.

The cylinder units 7 enable adjustment of the distance A between the cleaning nozzles 2 and the surfaces 8 of the rolls 1*a* and 1*b* to be cleaned. A constant spacing A between the nozzles 2 and the rolls 1*a*, 1*b* is maintained even when the rolls are ground down or have different diameters because of roll changes. The distance A remains constant even on repetitions of the back and forth cycling of the nozzles and is less than 100 mm. The speed with which the nozzles are traversed along the rails, i.e. of the drives 20 and 21 are controlled as a function of the strip speed. For this reason a speed sensor 28 is provided to detect the speed of the strip M and to provide an input to the controller 22 (FIG. 1) the speed of the nozzles along the rolls can, in addition, or alternatively be controlled in accordance with the strip material which can be inputted to the controller 22 by a keyboard or other inputting device as shown at 29. Finally, a strip surface quality detector 30 can provide an input.

The cleaning nozzles are rotation nozzles and the spraying angle between the rolls 1*a*, 1*b* and the nozzles 2 can be adjustable, for example, between 60° and 120°. The servocylinder 24 controls the angle 3 of tilt of the nozzle carriers with respect to the rolls. Strip cleaning nozzles 31 and 32 of adjustable angle can be provided upstream of the dressing rolls 1*a* and/or a strip cleaning nozzle 33 can be trained on the metal strip M where it passes around a roller 34. The cleaning liquid can be water which is deionized at 35 and is fed to a tank 36 in which anti-corrosion additives may be supplied. Pumps 37 and 38 deliver the cleaning liquid at pressures in excess of 100 bar to the cleaning nozzle.

We claim:

1. A method of cleaning a roll for processing strip in a mill line for production of metal strip, said method comprising the steps of:

(a) training a jet of a cleaning liquid from at least one nozzle against a surface of said roll to be cleaned;

(b) displacing said nozzle back and forth along said roll while rotating said roll and said jet impacts said surface;

(c) controlling a spacing between said nozzle and said surface and regulating said spacing during the back and forth displacement of said nozzle to maintain a value of said spacing; and (d) controlling a back and forth traverse speed of said nozzle as a function of at least one parameter selected from the group which consists of: strip speed; strip material and strip surface.

2. The method defined in claim 1 wherein said spacing is held constant for successive repetitions of said back and forth displacement of said nozzle.

3. The method defined in claim 1, wherein said spacing is less than 100 mm.

4. The method defined in claim 1 further comprising the step of directing at least one jet of a cleaning fluid against at least one side of said strip upstream of said roll for hydro-mechanically cleaning said strip.

5. The method defined in claim 4 wherein said strip is impacted by said cleaning fluid as it overpasses a roller.

6. The method defined in claim 1 wherein said cleaning liquid cleans said surface at a pressure of at least 100 bar.

7. The method defined in claim 1 wherein the cleaning liquid is a desalinated or salt-free water.

8. The method defined in claim 1, further comprising the step of adding a corrosion-limiting additive to said cleaning liquid.

9. The method defined in claim 1 wherein said mill line is a strip-casting line, a line for processing strip after casting or rolling, a strip rolling line or a strip line containing dressing-roll stands or after-rolling or sizing roll stands.

10. An apparatus for cleaning a roll for processing strip in a mill line for production of metal strip, said apparatus comprising:

at least one nozzle training a jet of a cleaning liquid against a surface of said roll to be cleaned;

means for displacing said nozzle back and forth along said roll while rotating said roll and while said jet impacts said surface; and means for controlling a spacing between said nozzle and said surface and regulating said spacing during the back and forth displacement of said nozzle to maintain a value of said spacing, said means for displacing including a carriage displaceable on rails parallel to said roll, said means for controlling including at least one piston-and-cylinder arrangement connected to said nozzle for controlling said spacing.

11. The apparatus defined in claim 10 wherein said nozzle is a rotation nozzle.

12. The apparatus defined in claim 10 wherein said arrangement is a pneumatic or hydraulic cylinder.

13. The apparatus defined in claim 12 wherein the spray angle of said nozzle with respect to said surface is adjustable in a range between 60° and 120°.

14. The apparatus defined in claim 13, further comprising means for adjusting an angle of said cylinder relative to said roll.

15. The apparatus defined in claim 12 wherein a plurality of nozzles are trained on said roll and are moved back and forth along said roll.

16. The apparatus defined in claim 10, further comprising at least one further nozzle trained on said strip at a variable angle upstream of said roll.

17. The apparatus defined in claim 16 wherein said nozzle is trained on said strip in a region in which said strip overpasses a roller.

18. The apparatus defined in claim 10 wherein said line is a strip-casting line, a line for processing strip after casting or rolling, a strip rolling line or a strip line containing dressing-roll stands or after-rolling or sizing roll stands.

* * * * *